US009897348B2

(12) United States Patent
Adler et al.

(10) Patent No.: US 9,897,348 B2
(45) Date of Patent: Feb. 20, 2018

(54) DEVICE FOR CONVERTING THERMAL ENERGY

(71) Applicant: ECOP TECHNOLOGIES GMBH, Linz (AT)

(72) Inventors: Bernhard Adler, Gramatneusiedl (AT); Sebastian Riepl, Vienna (AT)

(73) Assignee: ECOP TECHNOLOGIES GMBH, Linz (AT)

( * ) Notice: Subject to any disclaimer, the term of this patent is extended or adjusted under 35 U.S.C. 154(b) by 14 days.

(21) Appl. No.: 15/110,709

(22) PCT Filed: Jan. 8, 2015

(86) PCT No.: PCT/AT2015/050005

§ 371 (c)(1),
(2) Date: Jul. 8, 2016

(87) PCT Pub. No.: WO2015/103656

PCT Pub. Date: Jul. 16, 2015

(65) Prior Publication Data

US 2016/0377327 A1 Dec. 29, 2016

(30) Foreign Application Priority Data

Jan. 9, 2014 (AT) ..... A 50014/2014

(51) Int. Cl.
*F25B 3/00* (2006.01)
*F28D 11/04* (2006.01)

(52) U.S. Cl.
CPC ..... *F25B 3/00* (2013.01); *F28D 11/04* (2013.01)

(58) Field of Classification Search
CPC . F28D 11/04; F25D 3/12; F25D 3/122; F25D 2331/803; F25B 3/00
See application file for complete search history.

(56) References Cited

U.S. PATENT DOCUMENTS 3,258,197 A 6/1966 Hanson et al.
3,846,302 A 11/1974 Crocker
(Continued)

FOREIGN PATENT DOCUMENTS

WO 9830846 A1 7/1998
WO 2009015402 A1 2/2009

OTHER PUBLICATIONS

ISA European Patent Office, International Search Report Issued in Application No. PCT/AT2015/050005, dated Apr. 30, 2015, WIPO, 4 pages.

(Continued)

*Primary Examiner* — Emmanuel Duke
(74) *Attorney, Agent, or Firm* — McCoy Russell LLP

(57) ABSTRACT

The invention relates to a device for converting thermal energy of a low temperature into thermal energy of a high temperature by means of mechanical energy, and vice versa, comprising a rotor which is mounted so as to rotate about a rotational axis and in which a flow channel is provided for a working medium that circulates in a closed circuit process, said medium being conducted outwards, relative to the rotational axis, in a compression unit in order to increase pressure, and being conducted inwards, relative to the rotational axis, in an expansion unit in order to reduce pressure. At least one heat exchanger is provided for exchanging heat between said working medium and a heat exchange medium.

18 Claims, 13 Drawing Sheets

(56) References Cited

U.S. PATENT DOCUMENTS

| | | | | | |
|---|---|---|---|---|---|
| 4,285,202 | A * | 8/1981 | Bailly du Bois | F01K 11/04 | 60/650 |
| 4,420,944 | A * | 12/1983 | Dibrell | F01B 11/008 | 165/86 |
| 4,433,551 | A * | 2/1984 | Dibrell | F01B 5/006 | 165/86 |
| 2010/0199691 | A1 * | 8/2010 | Adler | F25B 3/00 | 62/56 |
| 2013/0042994 | A1 * | 2/2013 | Adler | F25B 3/00 | 165/8 |

OTHER PUBLICATIONS

International Bureau of WIPO, International Preliminary Report on Patentability Issued in Application No. PCT/AT2015/050005, dated Jul. 21, 2016, WIPO, 7 pages.

* cited by examiner

DEVICE FOR CONVERTING THERMAL ENERGY

CROSS REFERENCE TO RELATED APPLICATIONS

The present application is a U.S. National Phase of International Patent Application Serial No. PCT/AT2015/050005, entitled "DEVICE FOR CONVERTING THERMAL ENERGY," filed on Jan. 8, 2015, which claims priority to Austrian Patent Application No. A50014/2014, entitled "DEVICE FOR CONVERTING THERMAL ENERGY," filed on Jan. 9, 2014, the entire contents of each of which are hereby incorporated by reference for all purposes.

TECHNICAL FIELD

The invention relates to a device for converting thermal energy of a low temperature into thermal energy of a higher temperature by means of mechanical energy and vice versa with a rotor mounted so that it can rotate around a rotational axis, in which rotor is provided a flow channel for a working medium that passes through a closed cycle, which working medium is conducted essentially radially outward relative to the rotational axis in a compressor unit so as to increase the pressure and is constructed essentially radially inward relative to the rotational axis in an expansion unit so as to reduce the pressure, wherein at least one heat exchanger inwardly positioned relative to the rotational axis and at least one heat exchanger positioned outwardly relative to the rotational axis are provided for exchanging heat between the working medium and a heat exchange medium, wherein the heat exchangers are preferably arranged essentially parallel to the rotational axis of the rotor.

BACKGROUND AND SUMMARY

Already known from prior art are rotating heat pumps or heat engines, in which a gaseous working medium is conducted in a closed thermodynamic cycle.

Described in WO 2009/015402 A1 is a heat pump or heat engine, in which the working medium in a pipe system of a rotor runs through a cycle involving the steps of a) compressing the working medium, b) dissipating the heat from the working medium by means of a heat exchanger, c) expanding the working medium and d) supplying heat to the working medium by means of an additional heat exchanger. The pressure of the working medium is increased or reduced through centrifugal acceleration, wherein the working medium flows radially outward in a compression unit and radially inward in an expansion unit relative to a rotational axis. Heat is dissipated from the working medium on a heat exchange medium of the heat exchanger in a section of the pipe system running axially or parallel to the rotational axis, to which section is allocated a co-rotating heat exchanger that exhibits the heat exchange medium. This device already enables an efficient conversion of mechanical energy and thermal energy of a low temperature into thermal energy of a higher temperature.

In practice, stringent requirements are placed on the stability of the device, which can be exposed to high centrifugal forces due to the rotational movement of the rotor.

In prior art, the heat exchangers were clamped in the area of the front ends of the heat exchangers. In this embodiment, the heat exchangers can disadvantageously bend at the ends between the clamps during operation, thereby detracting from the stability of the arrangement. In addition, operating safety can hereby not be ensured.

WO 98/30846 A1 discloses a generic rotor device for converting thermal energy. U.S. Pat. No. 3,846,302 describes another type of device for the thermal treatment of slurry. Finally, U.S. Pat. No. 3,258,197 relates to another type of cooling device.

By contrast, the object of the present invention is to provide a rotating device for converting thermal energy as indicated at the outset, which is capable of reliably withstanding high forces with the device in operation.

In the device according to the invention, this is achieved in that the rotor comprises a support body, which supports the inner and/or outer heat exchanger over its longitudinal extension, so as to retain the inner and/or outer heat exchanger.

The device according to the invention uses the centrifugal acceleration of the rotating system to generate various pressure or temperature levels; heat of a high temperature is here removed from or fed to the compressed working medium, and heat of a comparably low temperature is fed to or removed from the expanded working medium. Depending on the flowing direction of the working medium, the device is here optionally operated as a heat pump or engine. Use is here made of a heat exchanger positioned inwardly relative to the rotational axis and at least one heat exchanger positioned outwardly relative to the rotational axis, which are preferably situated essentially parallel to the rotational axis of the rotor. The inner heat exchanger is provided for heat exchange at a lower temperature, and the outer heat exchanger for heat exchange at a higher temperature. Several inner heat exchangers and several outer heat exchangers are preferably provided, which each are situated at the same radial distances to the rotational axis. According to the invention, the rotor comprises a support body, which supports the inner and/or outer heat exchangers over the length of the heat exchanger between the end faces against radial forces that arise during operation. In this embodiment, the rotor comprises a support body that supports the inner and/or outer heat exchanger over the length of the heat exchanger between the end faces against radial forces that arise during operation. The heat exchanger is advantageously supported by the support body essentially uniformly in the longitudinal direction of the heat exchanger, so that only slight or non-critical bends arise along the heat exchanger. All heat exchangers are preferably mounted to a shared support body, which is situated so as to rotate around the rotational axis as a constituent of the rotor. This makes it possible to achieve an especially stable design, with which the forces encountered during device operation can be absorbed. The support body can consist of one component or several components spaced apart in the longitudinal direction of the heat exchanger.

In order to keep the support body essentially at the temperature of the at least one inner heat exchanger during device operation, it is advantageous if the at least one outer heat exchanger comprises an insulating element comprised of a thermally insulating material between the outer pipe and support body, wherein the inner heat exchanger remains free of an insulating element. In order to keep the absolute temperature low, the outer or axially remote heat exchangers, which during normal operation comprise a higher relative temperature than the inner or axially proximate heat exchangers, can be thermally insulated from the supporting element in particular via tubular insulating elements having a significantly lower thermal conductivity by comparison to the support body. The thermally insulating material preferably exhibits a tensile strength of at least 10 Mpa, so as to prevent any flow under the load. In addition, the thermally insulating material shall comprise a temperature stability that corresponds to the maximum temperature of the heat exchanger. Therefore, it would be appropriate to use a conventional polycarbonate at operating temperatures of up to a max. 120° C. At higher temperatures of up to approx. 200° C., use can be made of polyether ether ketone, in particular with fillers such as carbon fiber or glass fiber, polyamide, in particular with various fillers, hard fiber materials or other high-temperature materials with a low thermal conductivity. Given the thermal insulation of the support body from the outer heat exchanger on the one hand at the absence of such an insulating element on the inner heat exchanger on the other hand, essentially the temperatures of the inner heat exchanger are relevant for the support body. As a result, advantageously slight losses in strength arise in the support body, if any. This comes to bear in particular when using aluminum or aluminum alloys, since they as a rule exhibit a declining strength starting at approx. 50°. Another advantage to this embodiment is that lower temperature gradients come about inside the support body, since the temperature of the axially proximate heat exchanger sets in essentially up until the insulating layer around the axially remote heat exchanger. This results in a lower residual stress in the support body. At especially high temperatures, however, it is also conceivable that both the axially remote and axially proximate heat exchanger be thermally insulated from the support body via insulating elements. In this case, the support body can be equipped with an active cooler (e.g., based on water cooling, thermal radiation or convection), so as to prevent losses in strength of the support body.

In a preferred embodiment, the support body is manufactured as a cast body, in particular out of aluminum, wherein high-strength aluminum alloys, for example AlCu4Ti, are preferably used. Given the high thermal conductivity of aluminum, it is advantageous to arrange the insulating element at least on the inner heat exchanger.

Alternatively, the support body can be fabricated out of (for example bainitic) cast iron. The low thermal conductivity eliminates the need for the insulating element of the axially remote heat exchanger given a support body manufactured in this way. The low declines in strength at higher temperatures make this support variant very well suited for high-temperature applications.

The support body can further be fabricated out of steel with the use of welded joints, wherein this embodiment brings with it in particular cost advantages at comparatively high strength properties. Another advantage to a welded support body is the nearly unlimited size scaling. Diameters of at least 4 m are here conceivable for the rotor. Another advantage to this variant is that the low thermal conductivity of steel eliminates the need for an insulating element on the outer heat exchanger.

In addition, the support body can be fabricated out of fiber composites, which advantageously are very lightweight and have a high stiffness.

Furthermore, the support body can be put together out of semi-finished products, wherein aluminum plates and aluminum pipes and/or steel plates and steel pipes can be used, for example. All materials available in the form of plates or pipes can here be used as the semi-finished product. One advantage to this embodiment lies in the fact that directly using semi-finished products makes it possible to largely prevent losses in strength, in particular without post-processing at a high temperature (for example, while welding).

In order to absorb centrifugal forces, it is beneficial if the support body comprises several plate elements situated essentially perpendicular to the rotational axis and spaced apart in the direction of the rotational axis, which plate elements have recesses for mounting the heat exchangers. The plate elements can comprise cutouts or depressions, so as to reduce the weight of the support body and/or alter the stiffness of the plate elements. This can advantageously be used to achieve uniform deformations during the transition to the edge region, which can comprise an elevated weight. The plate elements are preferably spaced apart at identical distances. The plate elements are preferably designed like discs. In this embodiment, the heat exchangers sag slightly between the plates due to the centrifugal acceleration, giving rise to additional bending stresses that must be absorbed by the heat exchanger. However, the advantage to this embodiment is that an elevated strength in the raw materials can be achieved by using semi-finished products for manufacturing purposes. In this embodiment, it is further advantageous if the exterior side of the heat exchanger comprises a support pipe, which comprises depressions in the peripheral direction for accommodating the plate elements. Shear forces can hereby advantageously be absorbed.

Provided as the support body in an alternative embodiment is a profile body extended in the direction of the rotational axis, which profile body comprises an inner element with at least one inner recess for the at least one inner heat exchanger, and at least one outer element with at least one outer recess for the at least one outer heat exchanger. Given an arrangement of at least two outer or two inner heat exchangers, the profile body has a rotationally symmetrical design relative to the rotational axis.

In order to absorb the forces, it is especially beneficial for the inner element and outer element to be joined together via connecting bridges running essentially in a radial direction.

In order to diminish or uniformly distribute the stresses in the profile body, it is advantageous to provide several outer elements, wherein preferably precisely two connecting bridges are provided between the inner element and each outer element. The connecting bridges are preferably arranged with the outer elements around the inner element in a star-shaped manner. In terms of force transmission, it is beneficial for the distance between the connecting bridges to continuously increase outwardly in a radial direction. Alternatively or additionally, the width of the connecting bridge can diminish outwardly in a radial direction.

To achieve an especially stable embodiment at a low material outlay, it is beneficial for the at least one outer element of the support body to be designed as a cylindrical receptacle for the outer heat exchanger. Alternatively, the receptacle can be inwardly partially open. Because the axially remote heat exchanger is not continuously supported, one core per heat exchanger can be omitted when casting. In addition, the introduction of force in the axially remote heat exchanger can be improved, making it possible to reduce the stresses emanating from centrifugal forces.

A preferred embodiment further provides that the support body comprises a cylindrical enclosure that surrounds the outer elements. The outer elements are here fastened to the interior side of the cylindrical enclosure. The cylindrical jacket tangibly reduces the frictional losses in the rotating operating state of the device. The rotor is preferably operated in a space with an ambient pressure of less than 50 mbar absolute pressure, in particular less than 5 mbar absolute pressure.

BRIEF DESCRIPTION OF THE FIGURES

The invention will be explained in even greater detail below based on preferred exemplary embodiments shown in the drawing, but is not to be restricted thereto. Shown specifically in the drawing.

DETAILED DESCRIPTION

Figure 1:
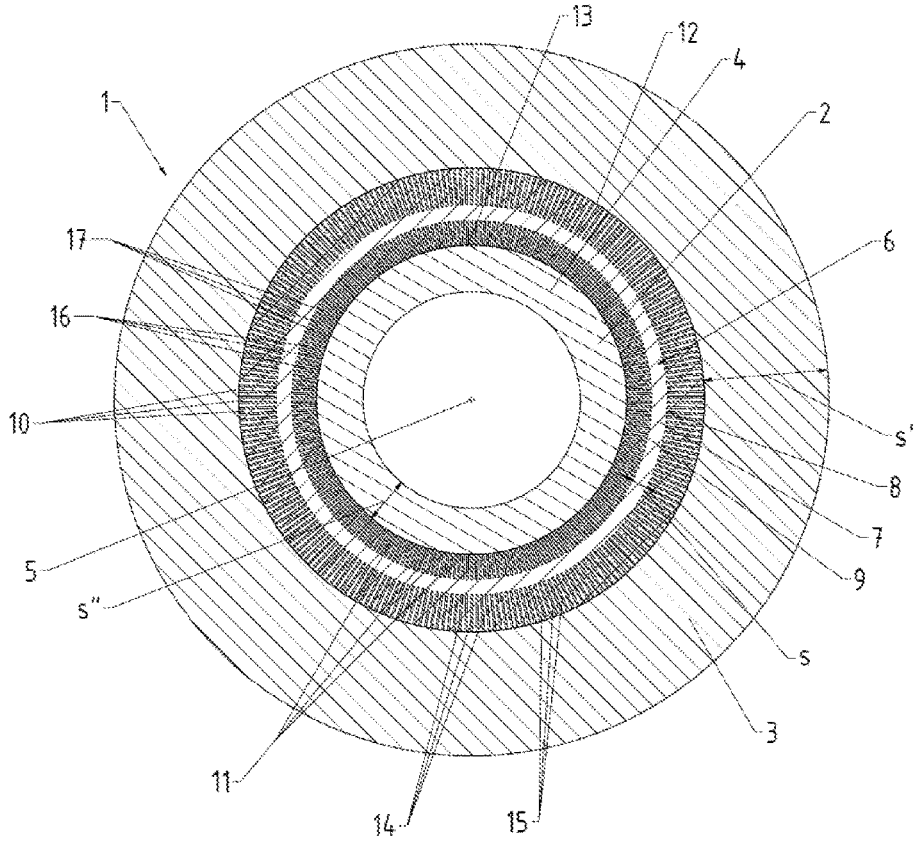
FIG. 1 is a cross section through a heat exchanger for a rotor device according to the invention for transmitting thermal energy, wherein a heat transmission pipe is situated between an inner pipe and outer pipe.
Figure 7:
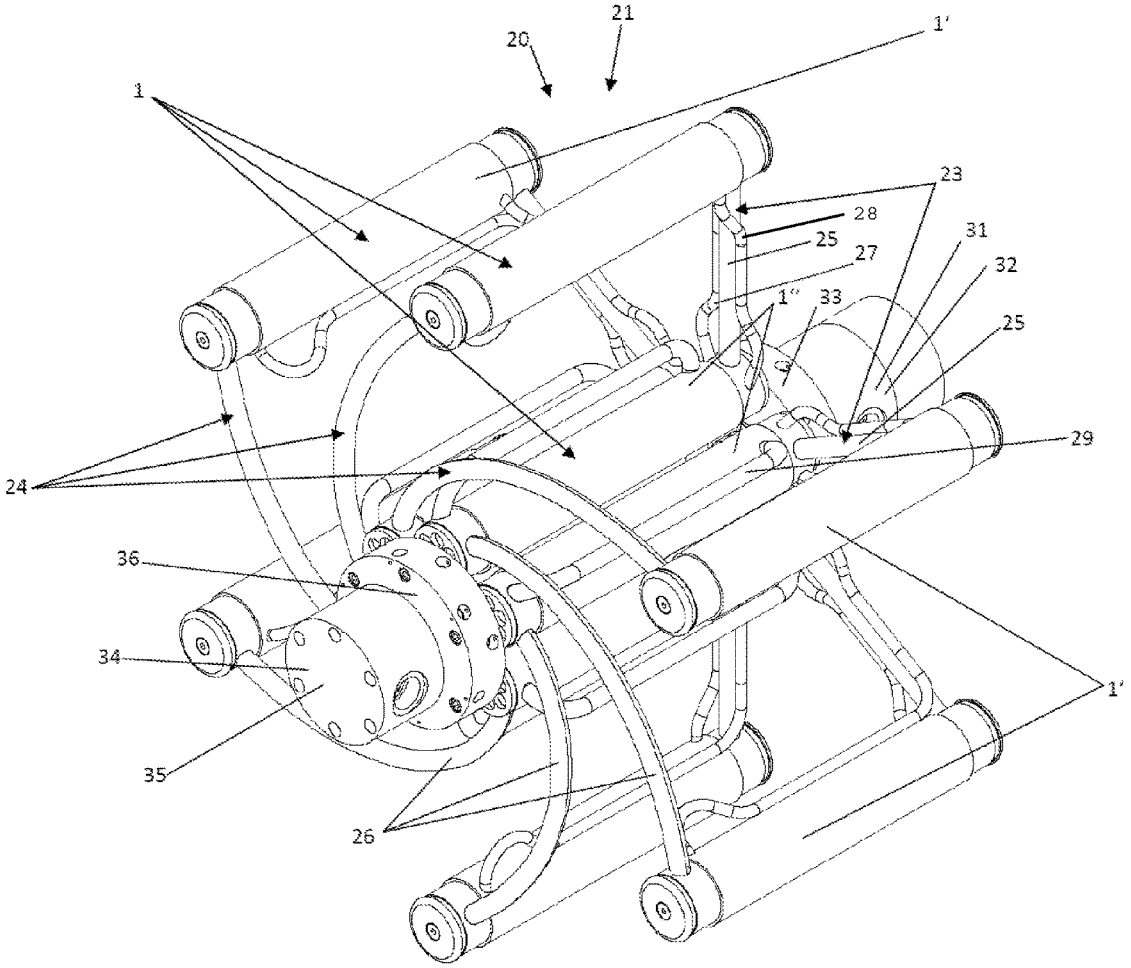
FIG. 7 is a view of a rotating device for converting thermal energy of a low temperature into thermal energy of a higher temperature, in which a working medium passes through a closed cycle in a rotor.

FIG. 1 shows a heat exchanger 1 to be installed in a rotating device 20 for converting thermal energy by means of mechanical energy and vice versa (see FIG. 7, 8). The heat exchanger 1 comprises an inner longitudinal element 2 and an outer pipe 3, which envelops the inner longitudinal element 2. A hollow inner pipe 4 is provided as the inner longitudinal element 2. The outer pipe 3 and inner pipe 4 are coaxially situated relative to a central longitudinal extension axis 5. Located between the inner pipe 4 and outer pipe 3 is a heat transmission pipe 6, which runs coaxially to the outer pipe 3 or inner pipe 4 in the longitudinal direction of the heat exchanger 1. The heat transmission pipe 6 comprises a wall 7 with an outer lateral surface 8 and an inner lateral surface 9, from which protrude outer lamellae 10 or inner lamellae 11. The lamellae 10, 11 extend in the direction of the longitudinal extension axis 5 of the heat transmission pipe 6. The outer lamellae 10 protrude from the outer lateral surface 8 outwardly in a radial direction up to an inner surface 12 of the outer pipe 3. The inner lamellae 11 project from the inner lateral surface 9 of the wall 7 of the heat transmission pipe 6 up to an outer surface 13 of the inner pipe 4. As a result, the heat transmission pipe 6 is held between the inner pipe 4 and outer pipe 3, wherein the outer lamellae 10 are supported against the outer pipe 3, and the inner lamellae 11 against the inner pipe 4. Formed between the outer lamellae 10 are spaces 14, which form heat exchange channels 15 for a first heat exchange medium. In a corresponding manner, spaces 16 between the inner lamellae 11 form heat exchange channels 17 for a second heat exchange medium.

As further evident from FIG. 1, a plurality, for example 250, of outer lamellae 10 or inner lamella 11 are provided, thereby forming outer heat exchange channels 15 for the first heat exchange medium or inner heat exchange channels 17 for the second heat exchange medium which channels are spaced apart at regular angular distances in the peripheral direction of the heat transmission pipe 6. It makes sense for the heat exchange medium with the lower absolute pressure to flow in the outer heat exchange channels 15 between the outer lamellae 10, wherein the second heat exchange medium with a considerably higher pressure can flow through the heat exchange channels 17 between the inner lamellae 11.

The bilateral support of the heat transfer pipe 6 allows the stresses in the area of the wall 7 of the heat transmission pipe 6 caused by the differential pressure to be transmitted to the outer pipe 3 via the outer lamellae 10. Conversely, forces introduced into the wall 7 can be transmitted to the inner pipe 4 via the inner lamellae 11, if the heat exchange medium with the higher pressure flows in the outer heat exchange channels 15. This yields a mechanically very stable arrangement of the heat transmission pipe 6, which arrangement can be designed with thin walls so as to optimize the heat transfer between the heat exchanger media. In the embodiment shown on FIG. 1, the ratio between a wall thickness s of the wall 7 of the heat transmission pipe 6 and a wall thickness s' of the outer pipe 3 measures about 0.2. In addition, the ratio between the wall thickness s of the heat transmission pipe 6 and a wall thickness s" of the inner pipe 4 measures about 0.3. The thin-walled design of the heat transmission pipe 6 allows heat to be transmitted at a high efficiency, which in particular also makes it possible to shorten the extension of the heat exchanger in the longitudinal direction, for example which has proven advantageous in the embodiment described based on FIGS. 7 and 8.

Figure 2:
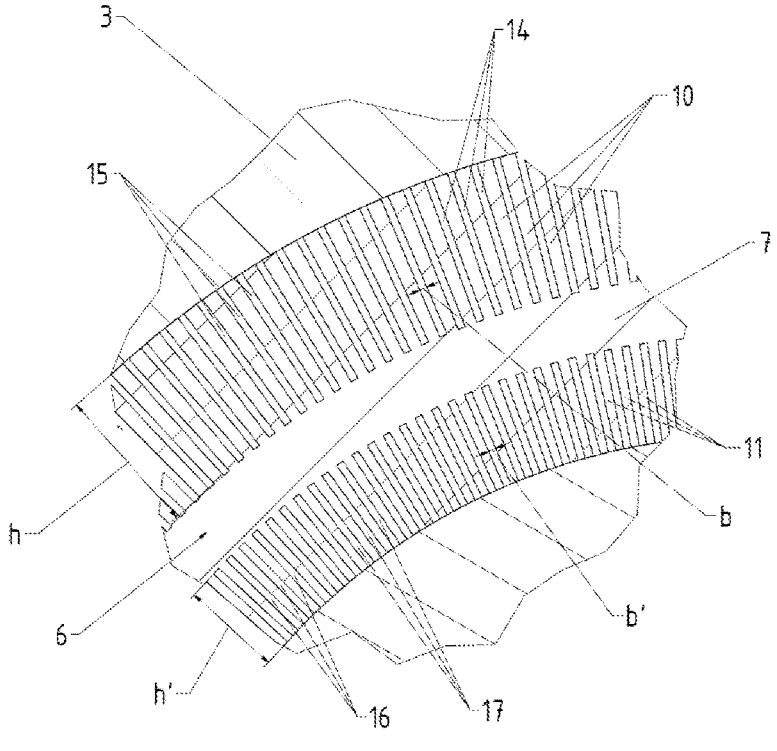
FIG. 2 is a cutout of the heat exchanger depicted on FIG. 1 on a comparatively magnified scale.

As evident in particular from FIG. 2, the outer lamellae 10 comprise a height h, i.e., an extension in a radial direction, which preferably exceeds one height h' of the inner lamellae 11. In a suitable embodiment, the ratio between the height h of the outer lamellae 10 and height h' of the inner lamellae 11 measures between 0.2 and 5, depending on the fluid, mass flow and pressures. As further evident from FIG. 3, the spaces 14 forming the outer heat exchange channels 15 comprise a width b of roughly 1 mm. A width b' of the spaces 16 between the inner lamellae 11 preferably corresponds to the width b of the spaces 14.

Figure 3:
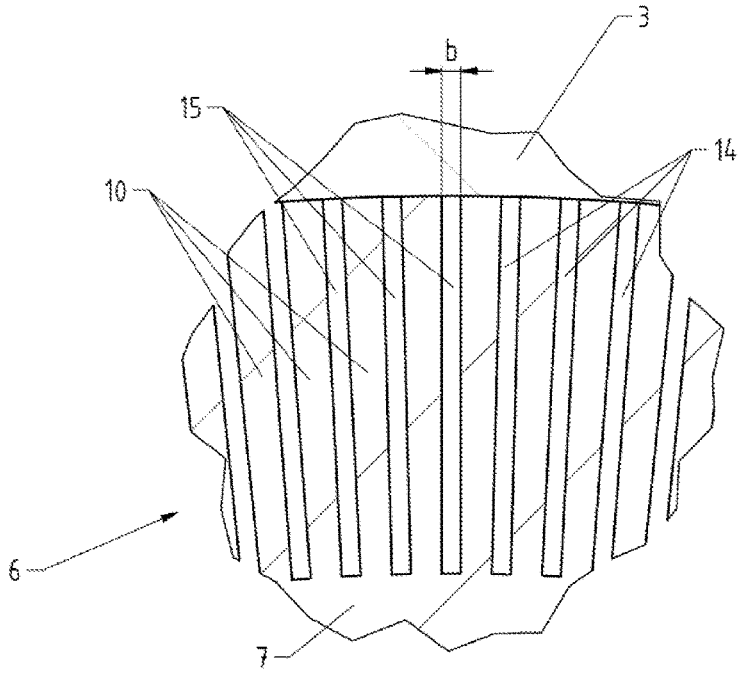
FIG. 3 is a further magnified cutout of the heat exchanger according to FIG. 1 or FIG. 2, wherein in particular outer lamellae of the heat transmission pipe are visible.

For purposes of suitable force transmission, the heat transmission pipe 6 is fabricated out of a material with a modulus of elasticity that is lower than the modulus of elasticity for the outer pipe 3 or inner longitudinal element 2. The heat transmission pipe 3 preferably is made out of an aluminum alloy or copper alloy. To achieve a high stiffness, the outer pipe 3 or inner longitudinal element 2 is fabricated out of a high-tensile steel alloy. The outer or inner lamellae 10 or 11 shown on FIG. 1 to 3 are best provided as millings, which can be introduced into a preform with a high accuracy.

Figure 4:
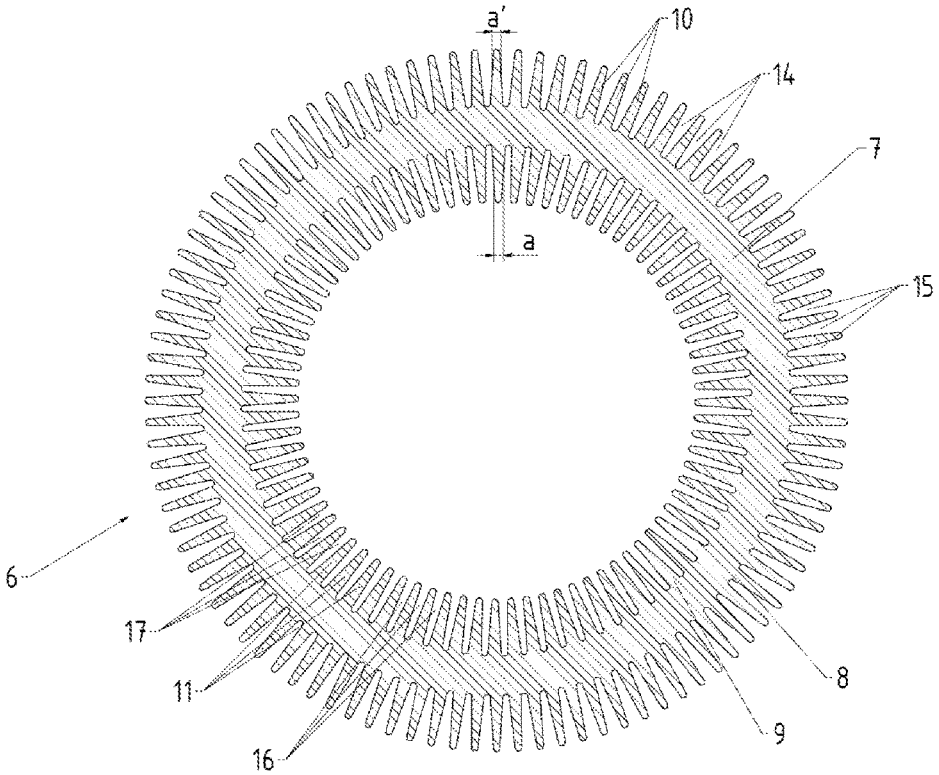
FIG. 4 is an alternative embodiment of a heat transmission pipe manufactured in an extrusion molding process, which is provided to be arranged in a heat exchanger according to FIGS. 1 to 3.
Figure 5:
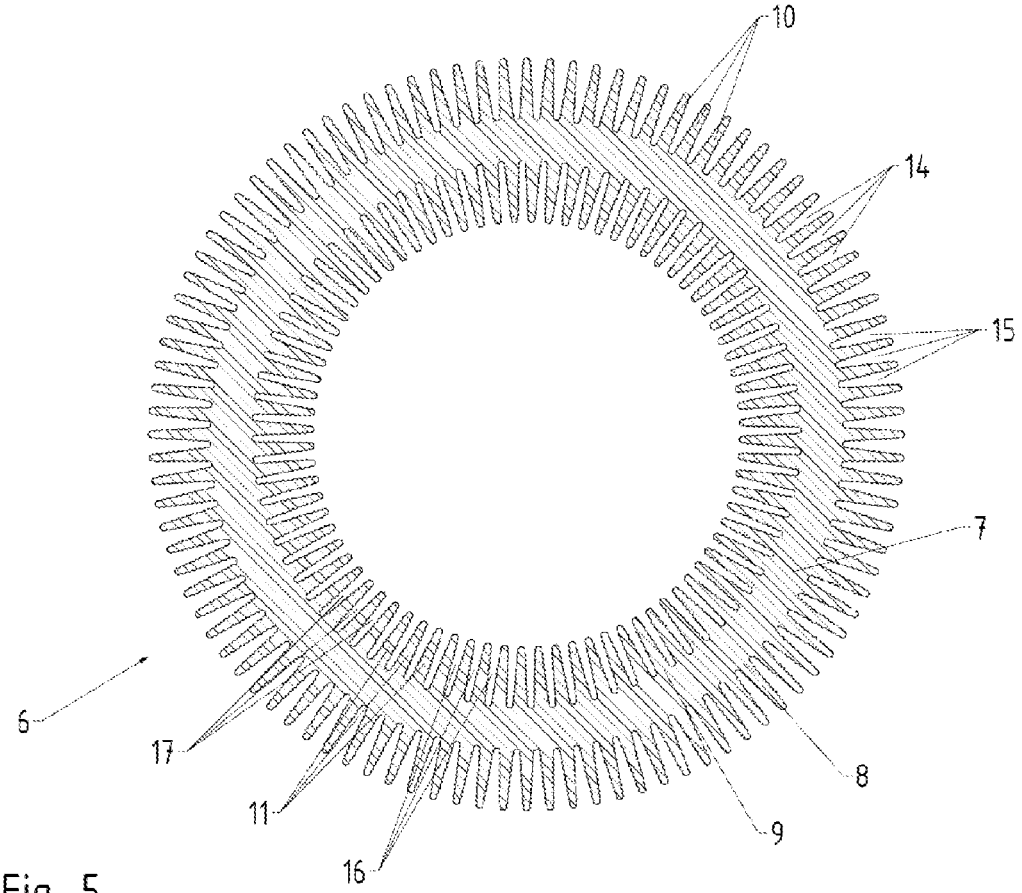
FIG. 5 is a modified embodiment of the heat transmission pipe depicted on FIG. 4, in which the surfaces of the lamellae are curved in a wavelike manner.
Figure 6:
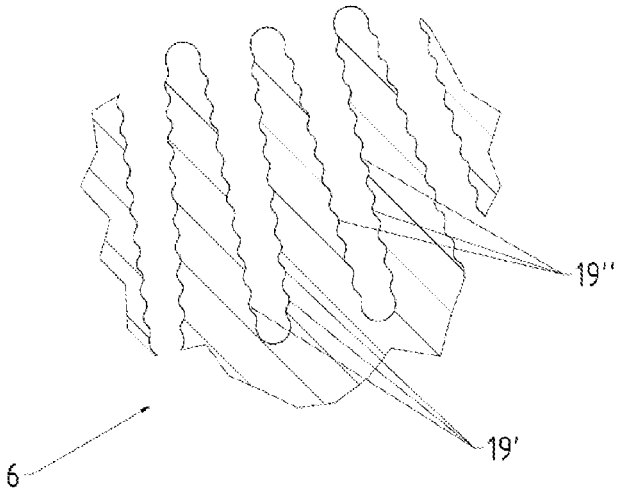
FIG. 6 is a cutout of the heat transmission pipe depicted on FIG. 5 on a comparatively magnified scale.

FIGS. 4 or 5 and 6 each show an alternative embodiment of the heat transmission pipe 6, which in particular was fabricated in an extrusion molding process. In this embodiment, a wall thickness a of the inner lamellae 11 or a wall thickness a' of the outer lamellae 10 tapers off inwardly in a radial direction and outwardly in a radial direction. Consequently, the extension of lamellae 10, 11 in the peripheral direction is greatest adjacent to the wall 7 of the heat transmission pipe 6, and continuously diminishes with increasing distance from the wall 7. In the embodiment shown, the edges of the outer lamellae 10 or inner lamellae 11 are rounded.

In the embodiment of the heat transmission pipe 6 shown on FIGS. 5 and 6, the outer lamellae 10 and inner lamellae 11 comprise contoured surfaces, which have valleys 19' and peaks 19" running in the direction of the longitudinal extension axis 5, thereby achieving a wavelike progression. In this way, the heat exchange surface available for heat exchange is significantly increased.

Figure 8:
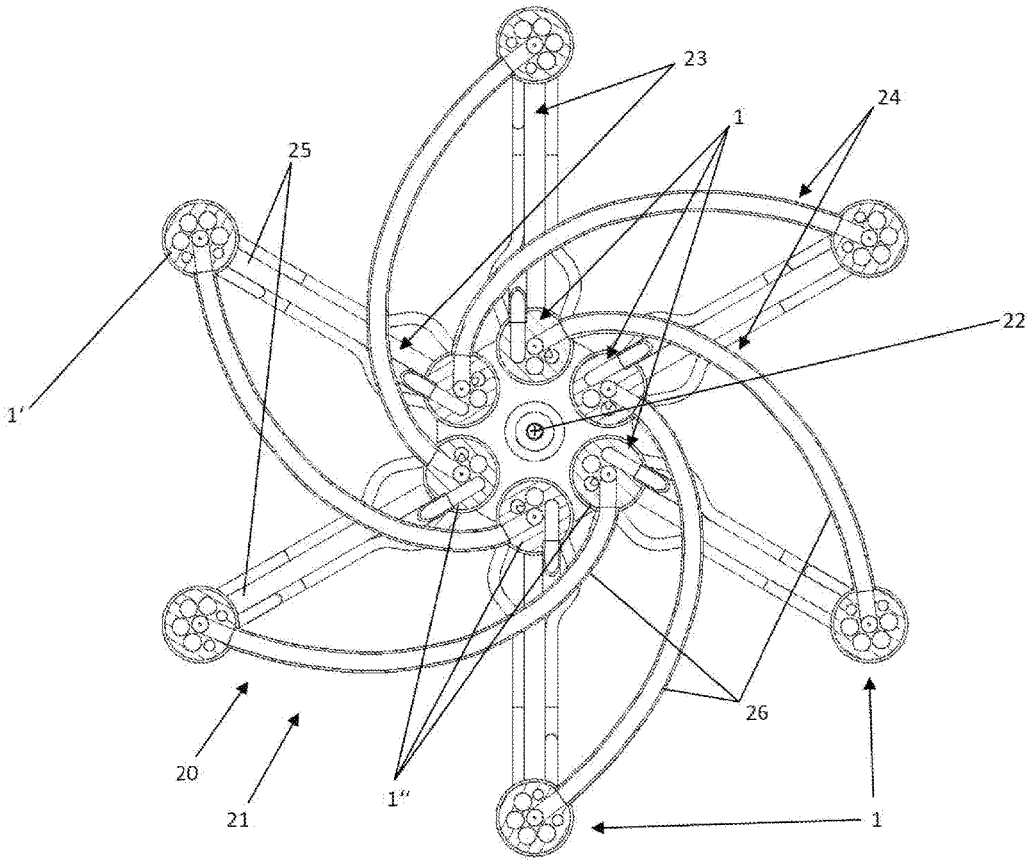
FIG. 8 is another view of the device depicted on FIG. 7.

FIGS. 7 and 8 show the arrangement of the heat exchanger 1 in a device 20 for converting mechanical energy into thermal energy and vice versa, which in particular is operated as a heat pump. Such a device 20—but with different heat exchangers—is described in AT 505 532 B1.

The device 20 comprises a rotor 21, which can be rotated around a rotational axis 22 by means of an engine (not depicted). Provided inside the rotor 21 is a flow channel for a working medium that runs through a closed cycle, for example an inert gas. The rotor 21 comprises a compressor unit 23 and an expansion unit 24, which form a pipe system. In radially extending compression pipes 25 of the compressor unit 23, the working medium flows outwardly in a radial direction relative to the rotational axis 22, wherein the working medium is compressed by the centrifugal acceleration. Accordingly, the working medium is essentially guided radially inward in expansion pipes 26 of the expansion unit 24 so as to reduce the pressure. The compressor unit 23 and expansion unit 24 are joined together by axially running sections of the pipe system, in which a heat exchange takes place with a heat exchange medium, for example water. Provided for this purpose are outer heat exchangers 1' or inner heat exchangers 1", in which the working medium compressed in the compression pipes 25 emits heat to a heat exchange medium of a first temperature, or the working medium expanded in the expansion pipes 26 absorbs heat from the heat exchange medium of a second temperature. Therefore, the centrifugal acceleration acting on the working medium is used to generate various pressure levels or temperature levels. Heat of a high temperature is extracted from the compressed working medium, and heat of comparatively lower temperature is fed to the expanded working medium.

The heat exchangers 1' or 1" are joined together so as to carry liquid via lines 27, 28 or 29. The heat exchange medium is fed to the pipe system via an inlet 31 of a static distributor 32; a co-rotating distributor 33 then feeds the heat exchange medium via the line 27 to the heat exchanger 1', in which it is returned with higher temperature via the line 28 to the co-rotating distributor 33. The static distributor 32 or an outlet is used to feed the heated heat transmission medium to a heat cycle.

The cold heat exchange medium of the heat exchanger 1" is guided via an inlet 34 of a static distributor 35, conveyed with another co-rotating distributor 36 in the co-rotating line 29 to the low-pressure heat exchanger 1", where heat is emitted to the gaseous working medium. The heat exchange medium is then fed to the static distributor 35 via the co-rotating distributor 36, and finally exits the device 20 through an outlet.

In order to achieve an appropriate heat transfer, the heat exchangers 1' or 1" take the form of the heat exchangers 1 described based on FIG. 1 to 6, wherein the working medium is provided as the second heat exchange medium, and the heat exchange medium is provided as the first heat exchange medium. In the embodiment shown, the working medium and heat exchange medium flow counter-currently in the heat exchange channels 15 or 17, wherein a suitable return of the heat exchange medium is to be ensured in the heat exchangers 1', 1".

Figure 9:
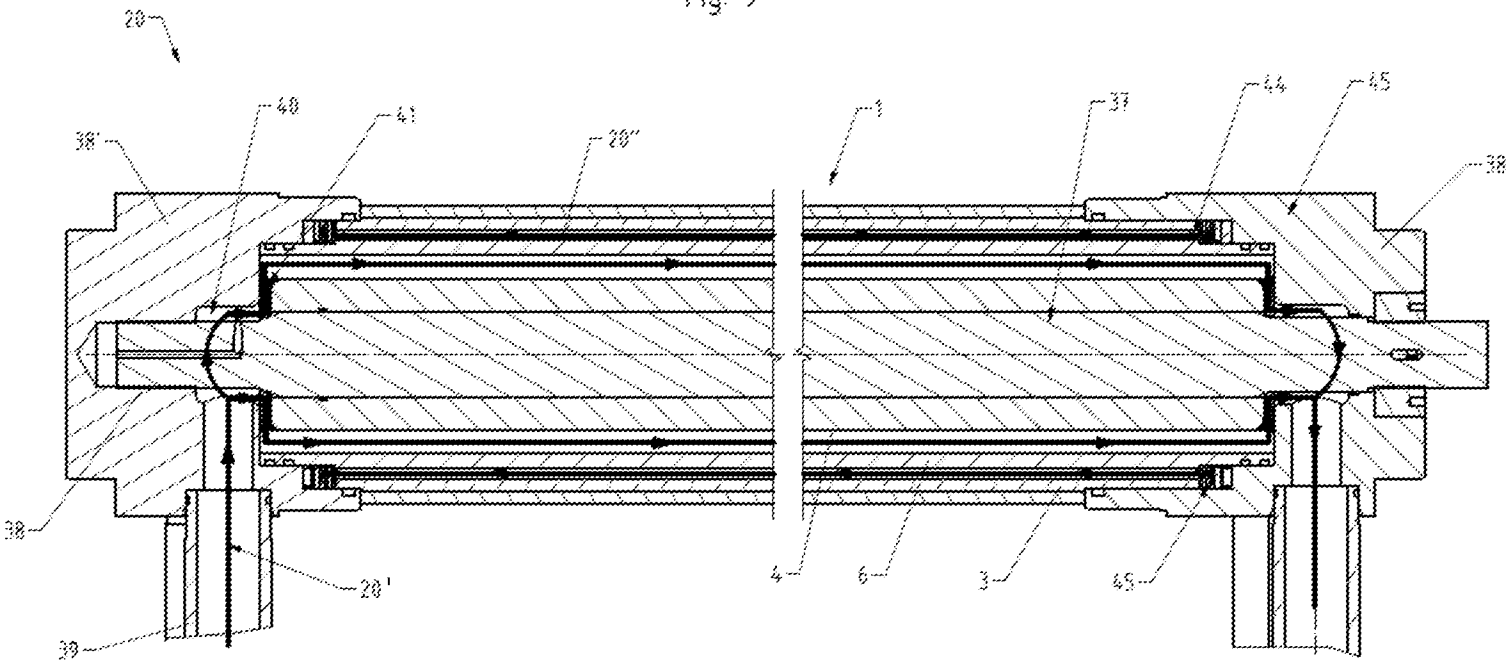
FIG. 9 is a longitudinal section through an alternative embodiment of the device in the area of the heat exchanger, wherein the flow of working medium and the flow of heat exchange medium are illustrated schematically (here in countercurrent)
Figure 10:
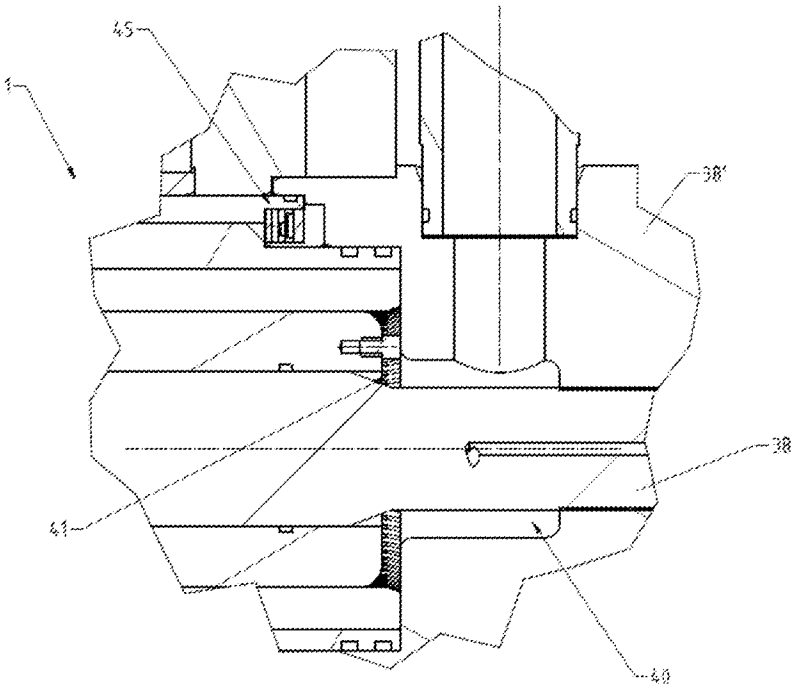
FIG. 10 is a magnified cutout of the device in the area of the heat exchanger.

FIG. 9 shows a longitudinal section through an alternative embodiment of the device 20 in the area of the heat exchanger 1, wherein the flow 20' of the working medium and the flow 20" of the heat exchange medium are schematically depicted. FIG. 10 presents a magnified cutout of the heat exchanger 1. According to the latter, the heat exchanger 1 comprises a tie rod 38 in a central cavity 37 of the inner pipe 4. Head sections 38' that cover the end faces of the heat exchanger 1 are fastened to the ends of the tie rod 38 which ends protrude from the inner pipe 4.

Figure 11:
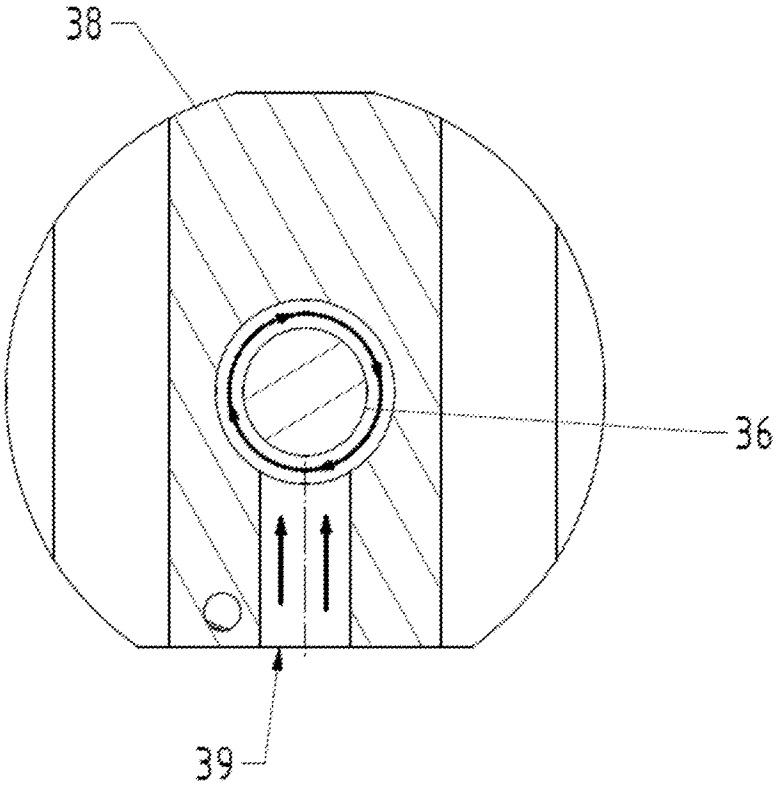
FIG. 11 is a sectional view of the device in the area of an annular gap for achieving a circulating flow of the working medium prior to entry into the heat exchanger.

As further evident from FIG. 9, the device 20 also comprises a feed line 39 for the working medium. The feed line 39 is connected with an annular gap 40, in which the linear flow in the feed line 39 is converted into a circular flow of the working medium around the longitudinal axis of the heat exchanger 1 (see FIG. 11). In the embodiment shown, the annular gap 40 is formed between the lateral surface of the end of the tie rod 38 which ends protrudes from the inner pipe 4 and an inner wall of the head section 38'. In addition, the heat exchanger 1 comprises also an annular space 41 after the annular gap 40 in the direction of flow, in which annular space 41 the transition takes place from the circular flow into the radial flow in the inner heat exchange channels 17.

Figure 12:
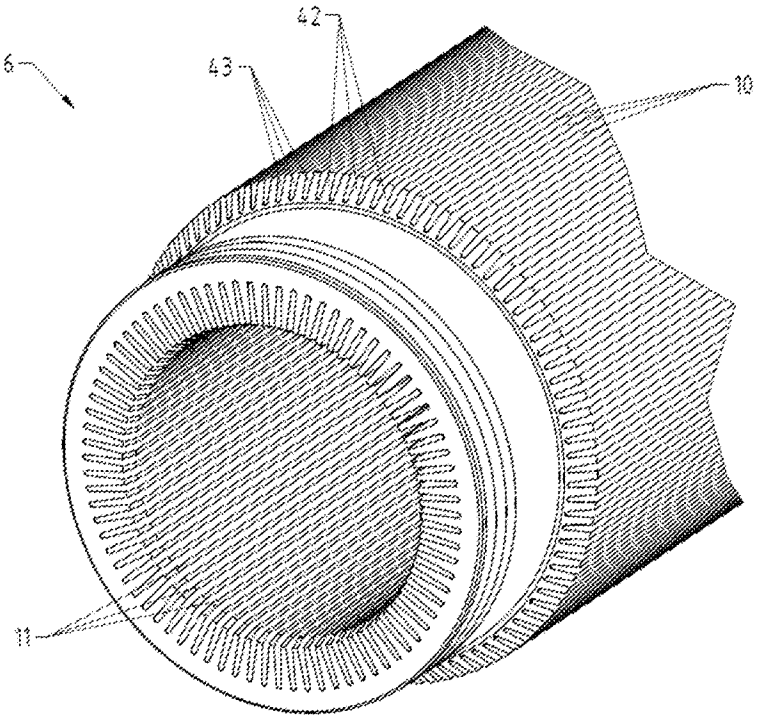
FIG. 12 is a perspective view of an embodiment of the heat transmission pipe of the heat exchanger, in which the front surfaces of the outer lamellae are bent forward as viewed in the direction of flow.

As evident from FIG. 12, the heat transmission pipe 6 comprises inlet openings 43 for the heat exchange medium between end faces 42 of the outer lamellae 10. The inlet openings 43 are connected with a feeder 44 for the heat exchange medium. In the embodiment shown, the end faces 42 of the outer lamellae 10 are inclined toward the front as viewed in the direction of flow. The optimal angle between the end faces 42 of the outer lamellae 10 and the longitudinal axis of the heat transmission pipe 6 is preferably selected as a function of the flow rate. At flow rates of less than 2 meters per second (m/s), steeper angles of greater than 45° are possible. At rates exceeding 2 m/s, shallower angles are advantageous. In general, preference goes to shallow angles, in particular to an angle of 45°, due to the limiting space requirement.

Figure 13:
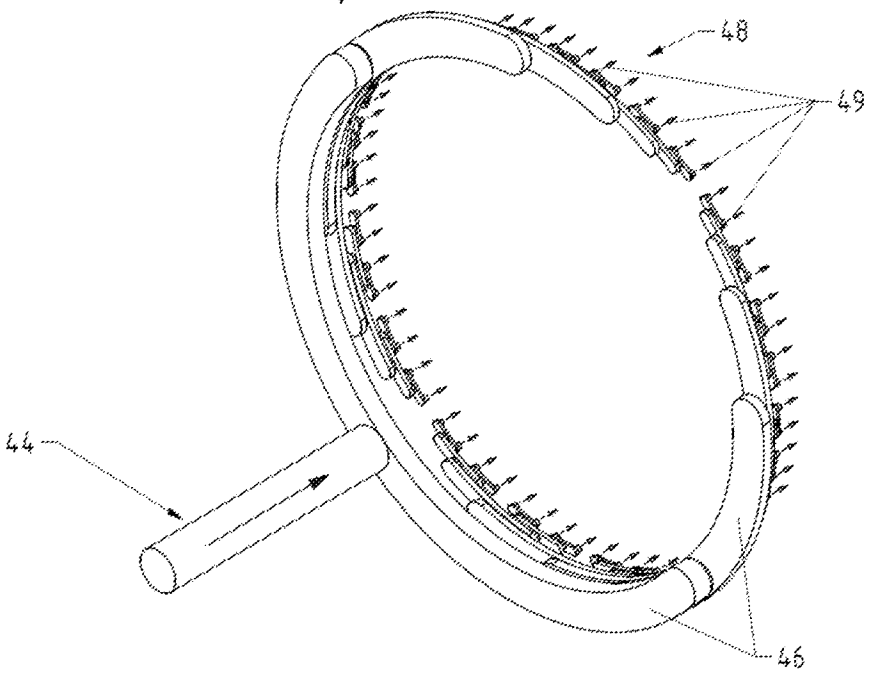
FIG. 13 is a perspective view of a distributor device, with which a linear flow of the heat exchange medium is divided into a plurality of annularly arranged partial flows.

As evident from FIG. 9, 10, see in particular also FIG. 13, 14, the heat exchanger 1 comprises a distributor device 45 between the inlet openings 43 of the outer heat exchange channel 15 and the feeder 44 for the heat exchange medium, which divides the flow of the heat exchange medium in the feeder 44 into several partial flows in the peripheral direction of the heat transmission pipe 6. The distributor device 45 comprises several stages comprised of circular-arc shaped distributor elements 46, which stages can carry a flow one after the other. The distributor elements 46 each comprise two passage openings 47 through which the heat exchange medium passes into the distributor elements 46 of the next stage, so that the flow passes parallel or simultaneously through the distributor elements 46 of the same stage. In the embodiment shown, each passage opening 47 is connected with precisely one distributor element 46, which essentially is arranged symmetrically relative to the passage opening 47. The passage openings 47 are here arranged at opposing ends of the circular arc-shaped distributor elements 46.

Figures 14A, 14B, 14C, 14D, 14E, 14F:
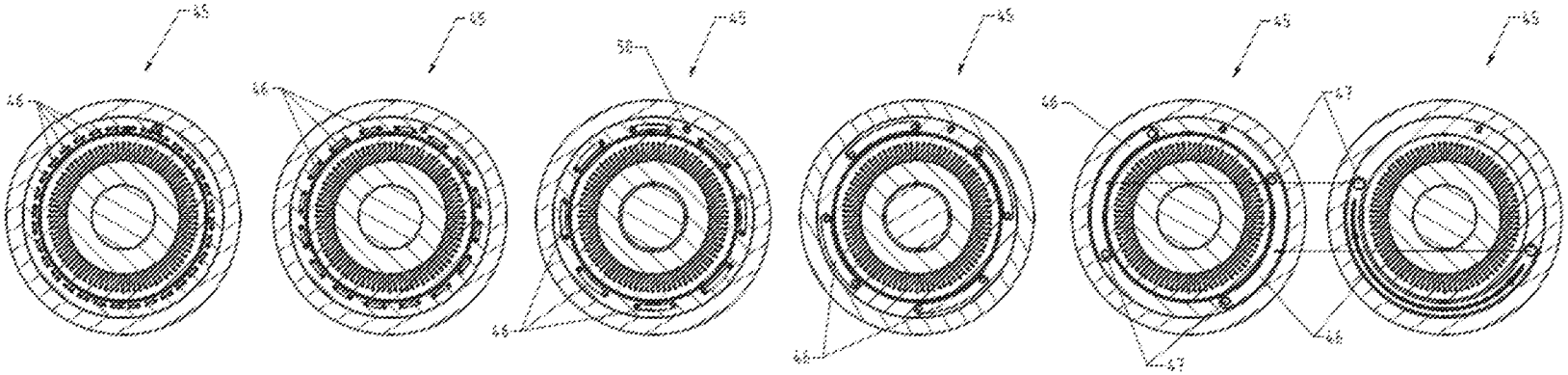
FIGS. 14A, 14B, 14C, 14D, 14E, and 14F are different sectional views of the distributor device according to FIG. 13.

As further evident from FIG. 13, 14, the length of the distributor elements 46 diminishes from stage to stage as viewed in the direction of flow. FIG. 14*a* to FIG. 14*f* depict sections through the individual stages of the distributor device 45, wherein FIG. 14*a* shows the inlet side of the distributor device 45, and FIG. 14*f* the outlet side of the distributor device 45. In the embodiment shown, the first distributor element 46 viewed in the direction of flow is semicircular, wherein the distributor elements 46 of the ensuing stages are comprised of correspondingly shorter arc elements. The outlet-side distributor elements 46 of the distributor device 45 are arranged in such a way as to form a circular ring-shaped outlet surface 48, which essentially comprises outlet openings 49 spaced apart by identical angular distances. The outlet openings 49 are situated directly before the inlet openings 43 of the outer heat exchange channels 15 in the direction of flow. Due to the symmetrical arrangement of the distributor elements 46, the heat exchange medium traverses essentially the same flow paths between the feeder 44 and the outlet openings 49 of the distributor device 45. Also evident from FIG. 14 are fastening means 50, with which the distributor elements 46 are held in a defined position relative to each other.

Figure 15:
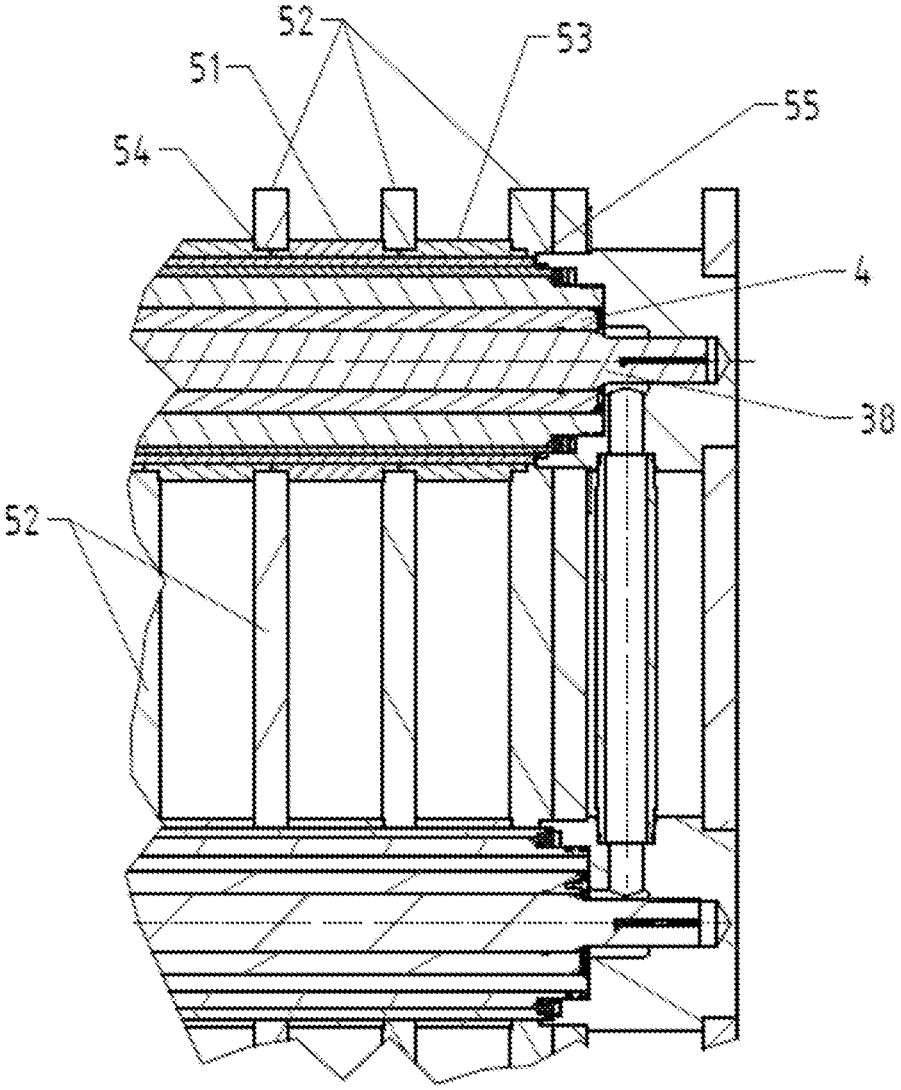
FIG. 15 is an embodiment of the device in which a support body with several plate elements is provided for mounting the heat exchangers.

FIG. 15 shows a portion of the device 20, wherein one of the heat exchangers 1" inwardly positioned relative to the rotational axis and one of the heat exchangers 1' positioned outwardly relative to the rotational axis are evident. The longitudinal axes of the heat exchangers 1', 1" are essentially situated parallel to the rotational axis of the rotor 21.

Figure 16:
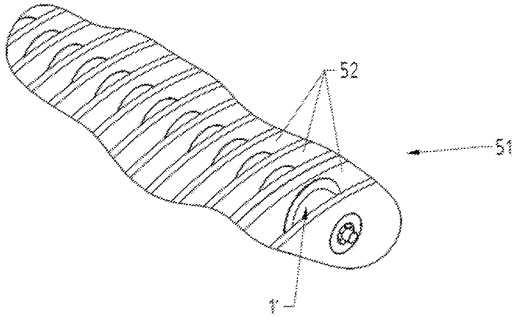
FIG. 16 is a cutout of the support body with a heat exchanger mounted therein.

As further evident from FIG. 15, the rotor 21 comprises a shared support body 51 for mounting the inner heat exchanger 1" and outer heat exchanger 1'. According to FIG. 15, the support body 51 comprises several plate elements 52 arranged essentially perpendicular to the rotational axis and spaced apart in the direction of the rotational axis (see also FIG. 16), which plate elements 52 have recesses for the heat exchanger 1', 1" to pass through. The heat exchangers 1', 1" are here jacketed with support pipes 53, which comprise gradations 54 for mounting the plate elements 52.

As further evident from FIG. 15, the outer heat exchangers 1' comprise a respective insulating element 55 comprised of a thermally insulating material between the outer pipes 3 and the support body 51. By contrast, the inner heat exchangers 1" remain free of such insulating elements, so that the support body 51 essentially assumes the temperature of the inner heat exchangers 1" during operation.

Figure 17:
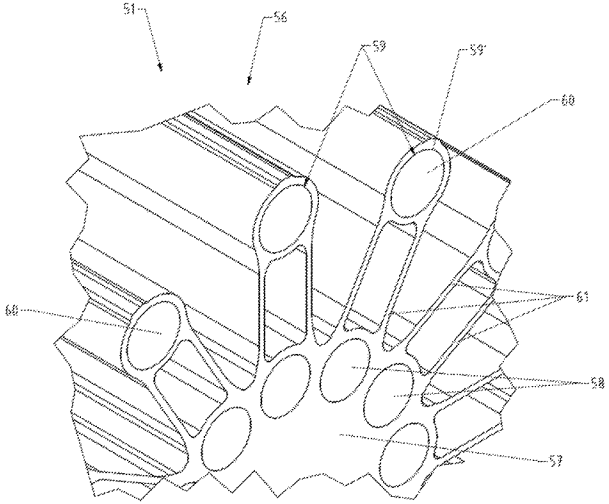
FIG. 17 is a perspective view of another embodiment of the support body with essentially parallel running connecting bridges.

FIG. 17 shows an alternative embodiment of the support body 51, which according to FIG. 17 is designed as a rotationally symmetrical profile body 56 relative to the rotational axis. The profile body 56 comprises an inner element 57 with several inner recesses 58 for accommodating the inner heat exchanger 1" and several outer elements 59 with outer recesses 60 for accommodating the outer heat exchangers 1'. Provided as outer elements 59 according to FIG. 17 are cylindrical receptacles 59' that are closed in the peripheral direction and enclose the outer recesses 60.

Figure 18:
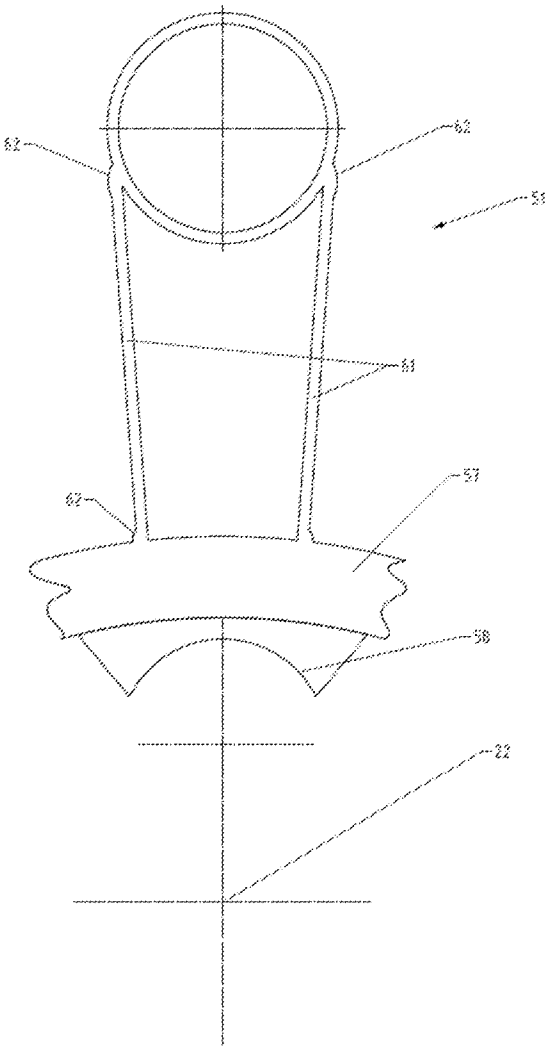
FIG. 18 is a view of another embodiment of the support body with connecting bridges that run in a radial direction of the rotor, and hence outwardly diverge from each other.

As evident from FIG. 17, 18, the inner element 57 is joined with each outer element 59 by precisely two connecting bridges 61 running in the radial direction. The distance between the connecting bridges 61 advantageously increases radially outward (see FIG. 18). The wall thickness of the connecting bridges advantageously diminishes in a radial direction. In the embodiment according to FIG. 18, the outer elements 59 are joined with the connecting bridges 61 by welded joints 62. In addition, welded joints 62 are provided between the connecting bridges 61 and the inner element 57. A positive connection can also be provided in place of the welded joints 62, for example a hammerhead joint or dovetail joint.

Figure 19:
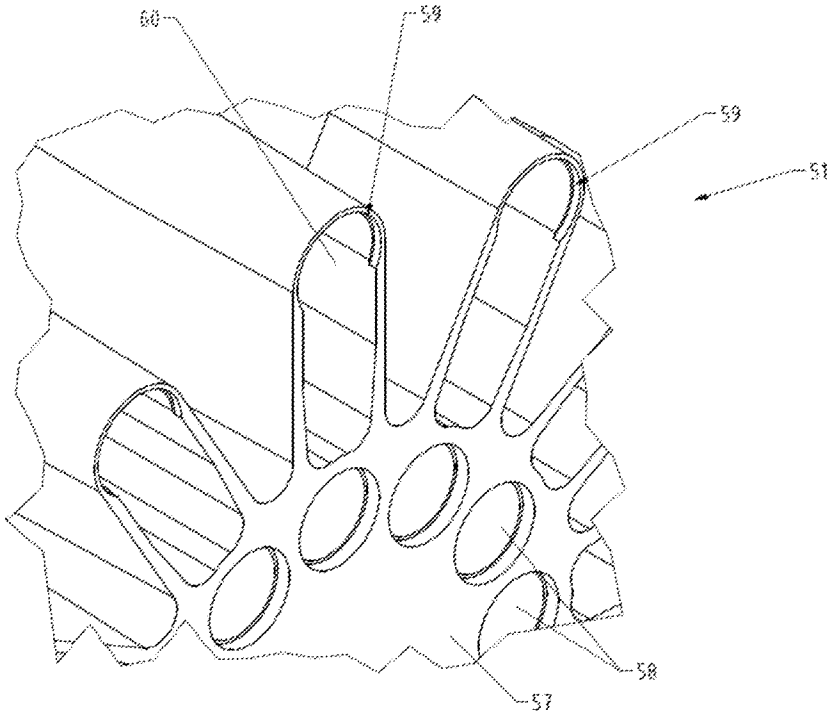
FIG. 19 is a perspective view of another embodiment of the support body.

FIG. 19 shows an alternative embodiment of the support body 51, wherein the outer elements 59 comprise open outer recesses 60 in the direction of the inner element 57.

Figure 20:
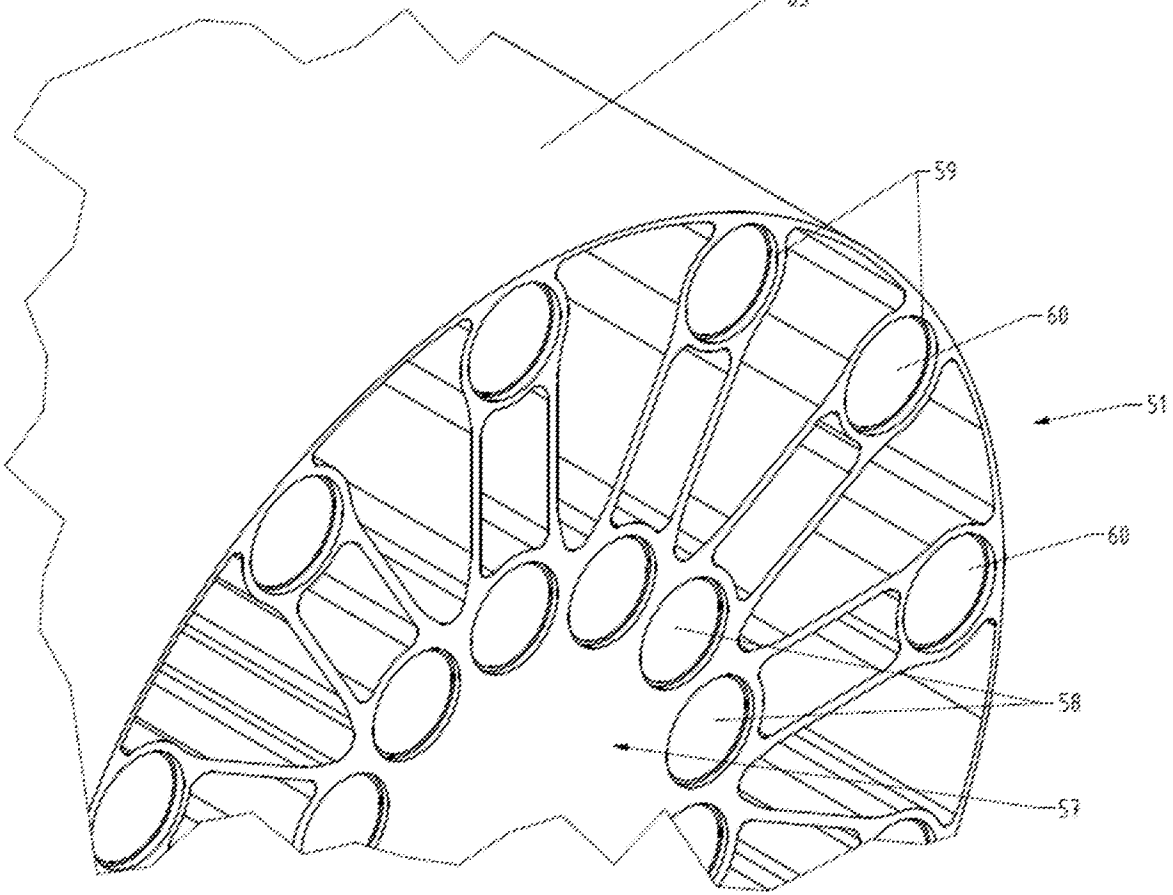
FIG. 20 is a perspective view of another embodiment of the support body.

FIG. 20 shows another embodiment of the support body 51, which according to FIG. 20 comprises a cylindrical enclosure 63 secured to the exterior side of the outer elements 59.

The invention claimed is:

1. A device for converting thermal energy of a low temperature into thermal energy of a higher temperature by means of mechanical energy and vice versa with a rotor mounted so that the rotor rotates around a rotational axis, wherein the rotor is provided with a flow channel for a working medium that passes through a closed cycle, wherein the working medium is conducted essentially radially outward relative to the rotational axis in a compressor unit so as to increase the pressure, and essentially radially inward relative to the rotational axis in an expansion unit so as to reduce the pressure, wherein at least one heat exchanger inwardly positioned relative to the rotational axis and at least one heat exchanger positioned outwardly relative to the rotational axis are provided for exchanging heat between the working medium and a heat exchange medium, wherein the rotor comprises a support body, which supports the inner and/or outer heat exchanger over longitudinal extension of the inner and/or outer heat exchanger, so as to retain the inner and/or outer heat exchanger.

2. The device according to claim 1, wherein the at least one outer heat exchanger comprises an insulating element comprised of a thermally insulating material between an outer pipe and the support body, wherein the inner heat exchanger remains free of the insulating element.

3. The device according to claim 2, wherein the support body comprises several plate elements situated essentially perpendicular to the rotational axis and spaced apart in a direction of the rotational axis, wherein the plate elements have recesses for mounting the heat exchangers.

4. The device according to claim 2, wherein a profile body extended in a direction of the rotational axis is provided as the support body, wherein the profile body comprises an inner element with at least one inner recess for the at least one inner heat exchanger, and at least one outer element with at least one outer recess for the at least one outer heat exchanger.

5. The device according to claim 1, wherein the support body comprises several plate elements situated essentially perpendicular to the rotational axis and spaced apart in a direction of the rotational axis, wherein the plate elements have recesses for mounting the heat exchangers.

6. The device according to claim 5, wherein a profile body extended in the direction of the rotational axis is provided as the support body, wherein the profile body comprises an inner element with at least one inner recess for the at least one inner heat exchanger, and at least one outer element with at least one outer recess for the at least one outer heat exchanger.

7. The device according to claim 1, wherein a profile body extended in a direction of the rotational axis is provided as the support body, wherein the profile body comprises an inner element with at least one inner recess for the at least one inner heat exchanger, and at least one outer element with at least one outer recess for the at least one outer heat exchanger.

8. The device according to claim 7, wherein the inner element and the outer element are joined together by connecting bridges running essentially in a radial direction.

9. The device according to claim 8, wherein several outer elements are provided, wherein two connecting bridges are provided between the inner element and each outer element.

10. The device according to claim 8, wherein the at least one outer element of the support body is designed as a cylindrical receptacle for the outer heat exchanger.

11. The device according to claim 8, wherein the support body comprises a cylindrical enclosure that surrounds the outer element.

12. The device according to claim 7, wherein several outer elements are provided, wherein two connecting bridges are provided between the inner element and each outer element.

13. The device according to claim 12, wherein the several outer elements of the support body are designed as cylindrical receptacles for the outer heat exchanger.

14. The device according to claim 12, wherein the support body comprises a cylindrical enclosure that surrounds the several outer elements.

15. The device according to one of claim 7, wherein the at least one outer element of the support body is designed as a cylindrical receptacle for the outer heat exchanger.

16. The device according to claim 15, wherein the support body comprises a cylindrical enclosure that surrounds the at least one outer element.

17. The device according to claim 7, wherein the support body comprises a cylindrical enclosure that surrounds the outer elements.

18. The device according to claim 1, wherein the heat exchangers are arranged essentially parallel to the rotational axis of the rotor.

* * * * *